US005102112A

United States Patent [19]

Takahashi

[11] Patent Number: 5,102,112

[45] Date of Patent: Apr. 7, 1992

[54] PAPER FEEDING DEVICE FOR IMAGE FORMING EQUIPMENT

[75] Inventor: Yasuhiro Takahashi, Tokyo, Japan

[73] Assignee: Ricoh Company, Ltd., Tokyo, Japan

[21] Appl. No.: 633,318

[22] Filed: Dec. 24, 1990

[30] Foreign Application Priority Data

| | | | |
|---|---|---|---|
| Dec. 22, 1989 | [JP] | Japan | 1-331148 |
| Feb. 23, 1990 | [JP] | Japan | 2-40985 |
| Nov. 30, 1990 | [JP] | Japan | 2-338480 |

[51] Int. Cl.[5] ..... B65H 3/44

[52] U.S. Cl. ..... 271/9; 271/127; 271/154; 271/157; 271/158; 271/164; 271/258

[58] Field of Search ..... 271/3, 9, 126, 157–159, 271/162, 164, 145, 3.1, 127, 152–156, 258

[56] References Cited

U.S. PATENT DOCUMENTS

| | | | |
|---|---|---|---|
| 4,908,673 | 3/1990 | Muramatsu | 271/3.1 X |

FOREIGN PATENT DOCUMENTS

| | | | |
|---|---|---|---|
| 69647 | 4/1983 | Japan | 271/9 |
| 153734 | 9/1984 | Japan | 271/9 |
| 177234 | 10/1984 | Japan | 271/9 |
| 118545 | 6/1985 | Japan | 271/9 |
| 223737 | 11/1985 | Japan | 271/145 |
| 262735 | 12/1985 | Japan | 271/145 |
| 188336 | 8/1986 | Japan | 271/9 |
| 257840 | 11/1986 | Japan | 271/9 |
| 255328 | 11/1987 | Japan | 271/126 |
| 2-2737 | 1/1989 | Japan | 271/3.1 |
| 1-87130 | 7/1989 | Japan | 271/3.1 |
| 1-3531 | 1/1990 | Japan | 271/3 |
| 1-38031 | 5/1990 | Japan | 271/9 |
| 2-04237 | 8/1990 | Japan | 271/9 |

*Primary Examiner*—D. Glenn Dayoan
*Assistant Examiner*—Boris Milef
*Attorney, Agent, or Firm*—Oblon, Spivak, McClelland, Maier & Neustadt

[57] ABSTRACT

A paper feeding device for image forming equipment effectively uses the space available in the equipment and thereby accommodates a greater number of paper sheets in successive paper storing stages without the equipment being increased in height. A first paper storing section is loaded with a stack of paper sheets in a position where a paper feeding arrangement is capable of feeding the paper sheets. A second paper storing section adjoins the first paper storing section on the side opposite to the paper feed side of the first paper storing section. A paper end sensor senses paper sheets stacked on the first paper storing section. A paper shifting mechanism shifts paper sheets stacked in the second paper storing section collectively to the first paper storing section. A controller controls the paper shifting mechanism such that when the paper end sensor determines that paper sheets are absent inthe first paper storing section, the mechanism shifts paper sheets from the second paper storing section to the first paper storing section.

16 Claims, 8 Drawing Sheets

PAPER FEEDING DEVICE FOR IMAGE FORMING EQUIPMENT

BACKGROUND OF THE INVENTION

The present invention relates to a paper feeding device for use with an electrophotographic copier, facsimile transceiver, laser beam printer or similar image forming equipment.

A paper feeding device for the above application is often implemented with a paper cassette removably mounted on the side of image forming equipment and loaded with a stack of paper sheets. Alternatively, a plurality of paper storing sections in the form of paper cassettes or trays may be arranged in multiple stages within image forming equipment and a base on which the equipment is mounted, as disclosed in Japanese Patent Publication No. 1374/1989, for example. The problem with the removable paper cassette scheme is that a substantial part of the cassette protrudes sideways from the equipment, increasing the overall size of the equipment and, therefore, the space for installation. The multi-stage paper storing sections are successful in reducing the overall size of the equipment since they do not protrude from the equipment. However, this kind of scheme requires the operator to pull out the paper cassette, tray or similar paper storing section every time the size of paper sheets stacked therein has to be changed. To save time and labor, therefore, such paper feeding device uses as great a number of paper storing sections as possible, but this undesirably increases the overall height of the equipment. It has been customary to limit the height of the individual paper storing sections and thereby the number of paper sheets to be stacked therein for the purpose of reducing the overall height of the equipment. In such a configuration, however, the paper storing section accommodating paper sheets of a commonly used size are apt to run out of the paper sheets in a short time, and, therefore, has to be supplied with paper sheets very often. In addition, since all the paper storing sections such as cassettes or trays have the same configuration, a substantial wasteful space is left in each of the sections which are loaded with paper sheets of relatively small sizes on the side opposite to the paper feed side.

SUMMARY OF THE INVENTION

It is therefore an object of the present invention to provide a paper feeding device for image forming equipment which effectively uses the space available in the equipment and thereby increases the number of paper sheets to be accommodated in successive paper storing sections without the equipment being increased in height.

It is another object of the present invention to provide a generally improved paper feeding device for image forming equipment.

A paper feeding device for image forming equipment of the present invention has paper feeding means for feeding paper sheets one by one to the equipment. A first paper storing section is loaded with a stack of paper sheets in a position where a paper feeding arrangement is capable of feeding the paper sheets. A second paper storing section adjoins the first paper storing section on the side opposite to the paper feed side of the first paper storing section. A paper end sensor senses paper sheets stacked on the first paper storing section. A paper shifting mechanism shifts paper sheets stacked in the second paper storing section collectively to the first paper storing section. A controller controls the paper shifting mechanism such that when the paper end sensor determines that paper sheets are absent in the first paper storing section, the mechanism shifts paper sheets from the second paper storing section to the first paper storing section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
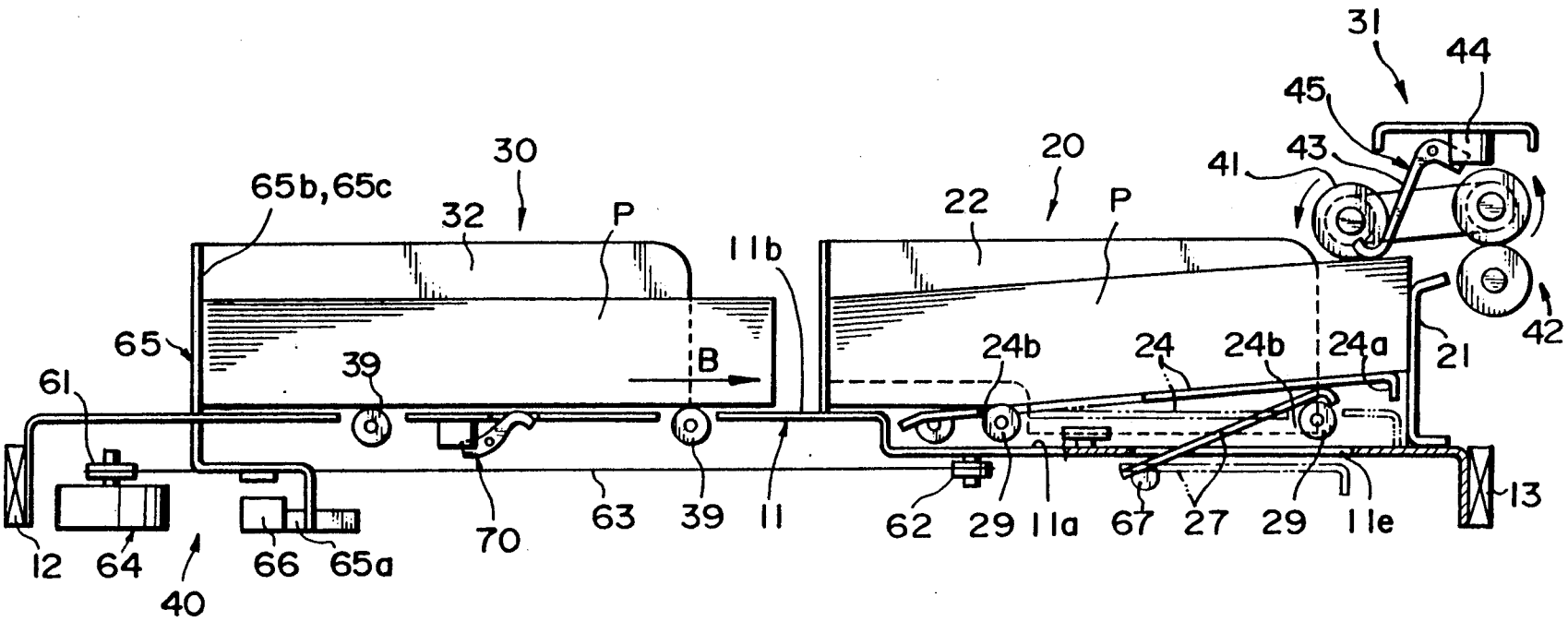
FIG. 1 is a partly sectional view showing a paper feeding device embodying the present invention.
Figure 2:
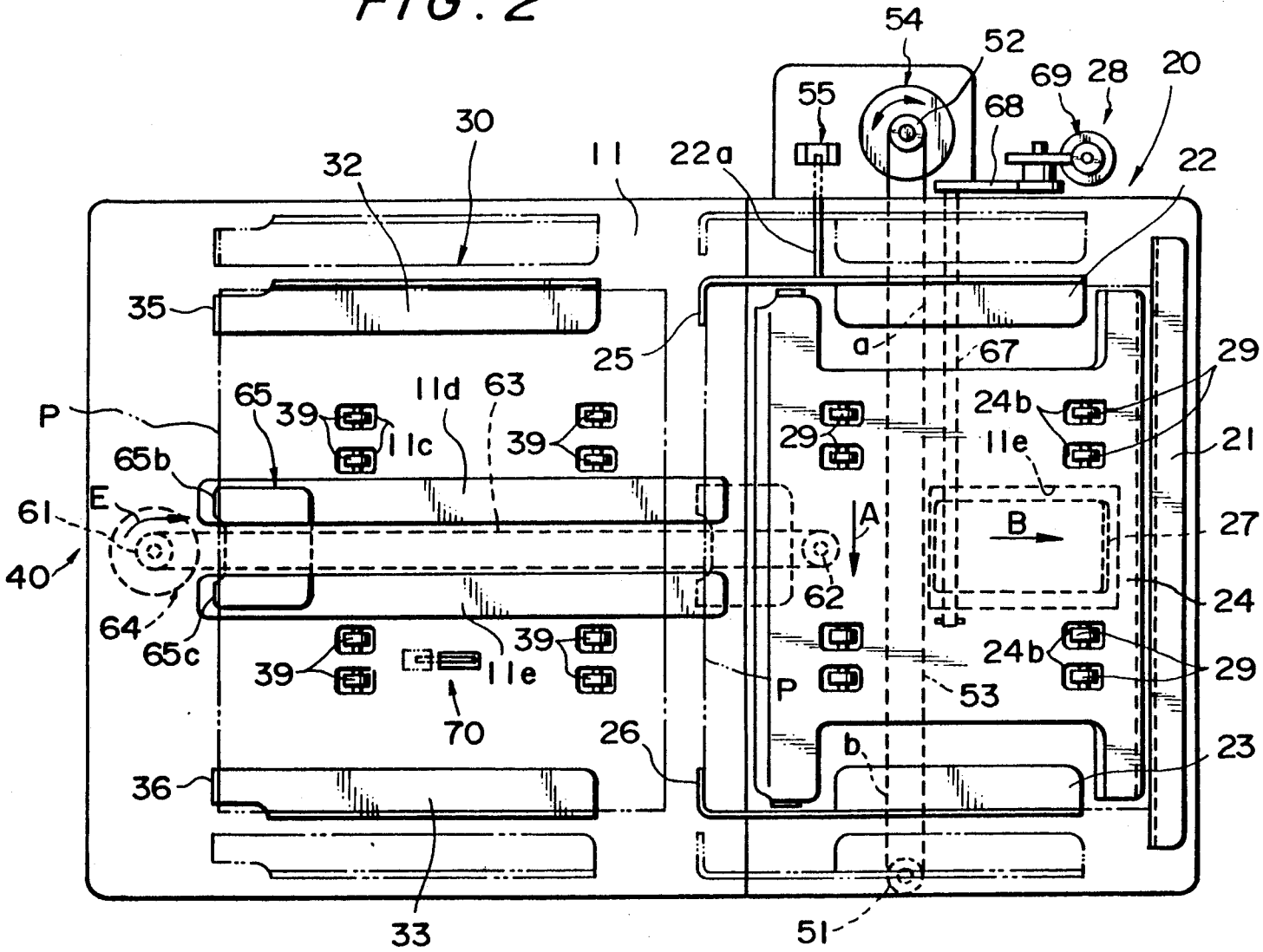
FIG. 2 is a plan view of the embodiment.

Referring to FIGS. 1 and 2, paper feeding device embodying the present invention is shown and includes a tray 11 loaded with a stack of paper sheets P. A pair of parallel slide rails 12 and 13 are affixed to the framework of the device. The tray 11 is mounted on the side rails 12 and 13 to be movable back and forth in a direction perpendicular to the sheet surface of FIG. 1. The tray 11 has a first paper storing section 20 and a second paper storing 30 which adjoins the first storing section 20 on the side opposite to the paper feed side. The first storing section 20 has a paper feed arrangement 31 at the paper feed side thereof. The paper feed arrangement 31 has a pick-up roller 41 and a pair of separation rollers 42. The pick-up roller 41 rotates in contact with top of the paper stack P accommodated in the first paper storing section 20 and thereby drives it to the right as viewed in FIG. 1. The separation roller pair 42 separates one paper sheet P from the stack P so driven by the pick-up roller 41. A paper end feeler 43 is rotatably supported at one end thereof and held in contact with the top of the paper stack P of the first storing section 20 at the other end thereof. The paper end feeler 43 constitutes a first paper end sensor 45 in cooperation with a sensor 44, as will be described.

Paper shifting means 40 moves the entire paper stack P accommodated in the second storing section 30 to the first storing section 20 when the paper end sensor 45 determines that the paper storing section 20 has run out of paper sheets P. The first storing section 20 is constituted by a part of the tray 11, an upright front fence 21 affixed to the paper feed end of the tray 11, a pair of side fences 22 and 23, FIG. 2, which are movable toward and away from each other to position the paper sheets P in the paper storing section 20 at opposite edges of the latter, and a bottom plate 24 rotatably mounted on the tray 11 at one end thereof such that the other end located on the paper feed side is movable up and down. As shown in FIG. 2, the ends of the side fences 22 and 23 located at the downstream side with respect to the intended direction of paper feed (left-hand side as viewed in FIG. 2) are bent substantially at right angles toward each other to form back fences 25 and 26, which are mounted in the storing section 20, respectively. The back fences 25 and 26 in cooperation position the rear edge of the paper stack of the storing section 20.

As shown in FIG. 1, an arm 27 is disposed below the bottom plate 24 and supported at the left end thereof to be rotatable counterclockwise to urge the bottom plate 24 upward. A drive mechanism 28, FIG. 2, drives the arm 27 in the counterclockwise direction as mentioned. The arm 27 and drive mechanism 28 serve as bottom plate pressing means in cooperation. As shown in FIG. 1, the bottom plate pressing means urges the paper stack P of the storing section 20 against the pick-up roller or paper feeding means 41 via the movable bottom plate 24. The part of the tray 11 corresponding to the storing section 20 is lower than the other part to form a stepped portion 11*a*, the bottom plate 24 being received in the stepped portion 11*a*. When the arm 27 is rotated clockwise to an inoperative position indicated by a phantom line in FIG. 1, the bottom plate 24 is lowered until a downward bend 24*a* formed by bending the right end of the plate 24 abuts against the upper surface of the stepped portion 11*a*. When the bend 24*a* is brought into contact with the stepped portion 11*a*, the upper surface of the bottom plate 24 is substantially flush with the upper surface 11*b* of the tray 11 other than the stepped portion 11*a*, as indicated by a phantom line in FIG. 1. A plurality of openings 24*b* are formed through the bottom plate 24. A roller, ball or similar rotatable member 29 is associated with each of the openings 24*b* and rotatable in the intended direction of paper feed (direction B, FIG. 1). In the lowered position of the bottom plate 24, the rotatable members 29 each slightly protrudes above the upper surface of the bottom plate 24 through associated one of the openings 24*b*.

The side fences 22 and 23 are supported by a guide member, not shown, to be movable toward and away from each other, as indicated by an arrow A in FIG. 2. Specifically, a wire 53 is passed over spaced pulleys 51 and 52, and the side fences 22 and 23 are respectively affixed to portions a and b of the wire 53 at the underside thereof. The pulley 52 is mounted on the output shaft of a reversible stepping motor 54. A lug 22*a* extends out sideways from the side fence 22 substantially perpendicularly to the latter, while a home sensor 55 is affixed to the framework of the device in alignment with the lug 22*a*. When the home sensor 55 senses the lug 22*a*, as indicated by a phantom line in FIG. 2, the side fences 22 and 23 are determined to be in their home position. In the illustrative embodiment, the home sensor 55 is implemented as a transmission type photosensor.

The second storing section 30 is constituted by a part of the tray 11 located at the left-hand side as viewed in FIG. 2, a pair of semi-stationary side fences 32 and 33 for positioning the side edges of the paper stack P on the tray 11, and back fences 35 and 36 formed by bending, respectively, the downstream side (left-hand side) of the side fences 32 and 33 substantially perpendicularly toward each other. The back fences 35 and 36 each may be implemented by a member physically separate from the associated side fence 32 or 33, if desired. Openings 11*c* are formed through the bottom of the second paper storing section 30, while rotatable members 39 identical with the rotatable members 29 are associated with the openings 11*c* to be rotatable in the intended direction of paper feed. The rotatable members 39 constantly protrude slightly above the openings 11*c* to shift the paper stack P smoothly from the second storing section 30 to the first storing section 20. Regarding the positions of the rotatable members 29 and 39, it is necessary that at least two rotatable members be located at spaced positions in the direction perpendicular to the paper feed direction, i.e., in the direction A and at a distance small enough to support the minimum size of paper sheets. In the paper feed direction (direction B, FIG. 2), the rotatable members 29 and 39 are positioned such that at least two sets thereof, i.e., the member 29 and 29, the members 29 and 39, or the members 39 and 39 are capable of supporting the minimum size of paper sheets at any on the tray 11. The rotatable members 29 and 30 each is rotatable independently of the others and may be implemented as a roller made of resin having a small coefficient of friction.

A presser plate 65 is located substantially at the center of the tray 11 with respect to the widthwise direction of paper sheets and supported by a guide member, not shown, to be movable in the direction B, FIG. 2. Abutments 65*b* and 65*c* extend upward from the presser plate 65 through slots 11*d* and 11*e*, respectively, which are formed through the tray 11. The slots 11*d* and 11*e* extend in the direction B. A wire 63 is passed over pulleys 61 and 62 which are spaced apart in the right-and-left direction as viewed in FIG. 2. The presser plate 65 is affixed to the wire 63 at a portion c thereof. The pulley 61 is mounted on the output shaft of a reversible stepping motor 64. In this configuration, the motor 64 selectively drives the pressor plate 65 in the direction B or in the other direction. When the presser plate is moved to the right, it positively and mechanically moves the paper sheets P stacked in the second storing section 30 bodily to the first storing section 20.

As shown in FIG. 1, a tongue 65*a* extends out from the lower end of the presser plate 65 while a home sensor (transmission type photosensor) 65 is affixed to the framework of the device in alignment with the tongue 65. When the home sensor 66 senses the tongue 65*a*, as shown in FIG. 1, it is determined that the pressor plate 65 is in a home position. A paper sensor 70 is mounted on the underside of the second storing section 30 for sensing the paper sheets P accommodated in the section 30.

While the home position of the pressure plate 65 is shown as being coincident with the position of the back fences 35 and 36, FIG. 2, such is only illustrative.

Figure 3:
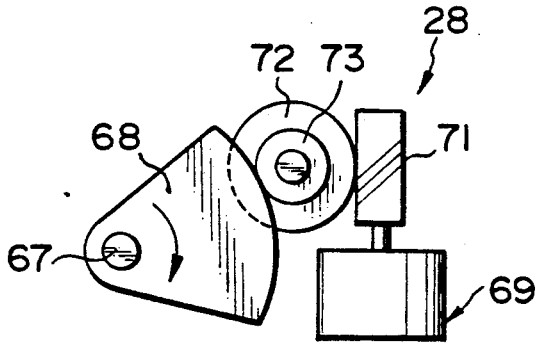
FIG. 3 is a view of a drive mechanism for rotating a bottom plate.

Referring also to FIG. 3, the drive mechanism 28 associated with the bottom plate 24 has a shaft 67 rotatably mounted on the underside of the stepped portion 11*a* of the tray 11. The arm 27 is affixed to one end of the shaft 67, as shown in FIG. 2. A sector gear 68 is rigidly mounted on the other end (upper end in FIG. 2) of the shaft 67. As FIG. 3 indicates, a reversible motor 69 drives the sector gear 68 via a worm 71, a worm wheel 72 meshing with the worm 71, and a gear 73 mounted integrally with the worm wheel 72. When the shaft 67 is rotated counterclockwise as viewed in FIG. 1, the arm 27 protrudes above the tray 11 through an opening 11*e* formed through the latter. As a result, the arm 27 raises the bottom plate 24 to a paper feed position where the pick-up roller 41 can feed the uppermost paper sheet P. As a limit switch or similar upper limit sensor senses the rise of the bottom plate 24 to the paper feed position, the motor 69 is deenergized to stop the elevation on the bottom plate 24.

How the illustrative embodiment feeds paper sheets of relatively small size will be described.

The first and second storing sections 20 and 30 both are loaded with paper sheets P of the same size. The drive mechanism 28, FIG. 2, is operated to raise the bottom plate 24 to the paper feed position shown in FIG. 1. Then, the pick-up roller starts feeding the paper sheets P from the first storing section 20. As the first storing section 20 runs out of paper sheets P, the paper end feeler 43 is rotated counterclockwise in FIG. 1 with the result that the paper end sensor 45 determines that no paper sheets P exist in the section 20. In response, the motor 69 of the drive mechanism 28 is energized to rotate the sector gear 68 in a direction indicated by an arrow D via the worm 71, worm wheel 72, and gear 73, whereby the arm 27 is lowered to the position indicated by a phantom line in FIG. 1. As a result, the bottom plate 24 is lowered until the bend 24*a* thereof rests on the upper surface of the stepped portion 11*a* of the tray 11, as also indicated by a phantom line in FIG. 1. In this condition, the upper surface of the bottom plate 24 is substantially flush with the upper surface 11*b* of the tray 11.

As the paper sensor 70 determines that paper sheets P exist in the second storing section 30, the stepping motor 54 is energized to move the side fences 22 and 24 of the first storing section 20 to their home position indicated by phantom lines in FIG. 2. Thereafter, the stepping motor 64 of the shifting means 40 is energized to rotate the wire 63 in a direction indicated by an arrow E in FIG. 2. Then, the presser plate 65 is moved toward the first storing section 20, collectively shifting the paper stack P from the storing section 30 to the bottom plate 24 of the storing section 20. Thereupon, the motor 54 is reversed to move the side fences 22 and 23 toward each other for positioning the side edges of the paper stack having been transferred to the storing section 20. The motor 69 of the drive mechanism 28 is reversed to rotate the arm 27 counterclockwise or upward as viewed in FIG. 1. As a result, the bottom plate 24 raises the paper stack P loaded thereon to to the paper feed position, FIG. 1. Further, the motor 64 is reversed to return the presser plate 65 to the home position shown in FIGS. 1 and 2. It is to be noted that the displacement of the side fences 22 and 23 and the displacement of the presser plate 65 away from their home positions each is programmed in a controller beforehand in matching relation to the paper size, as will be described.

Figure 4:
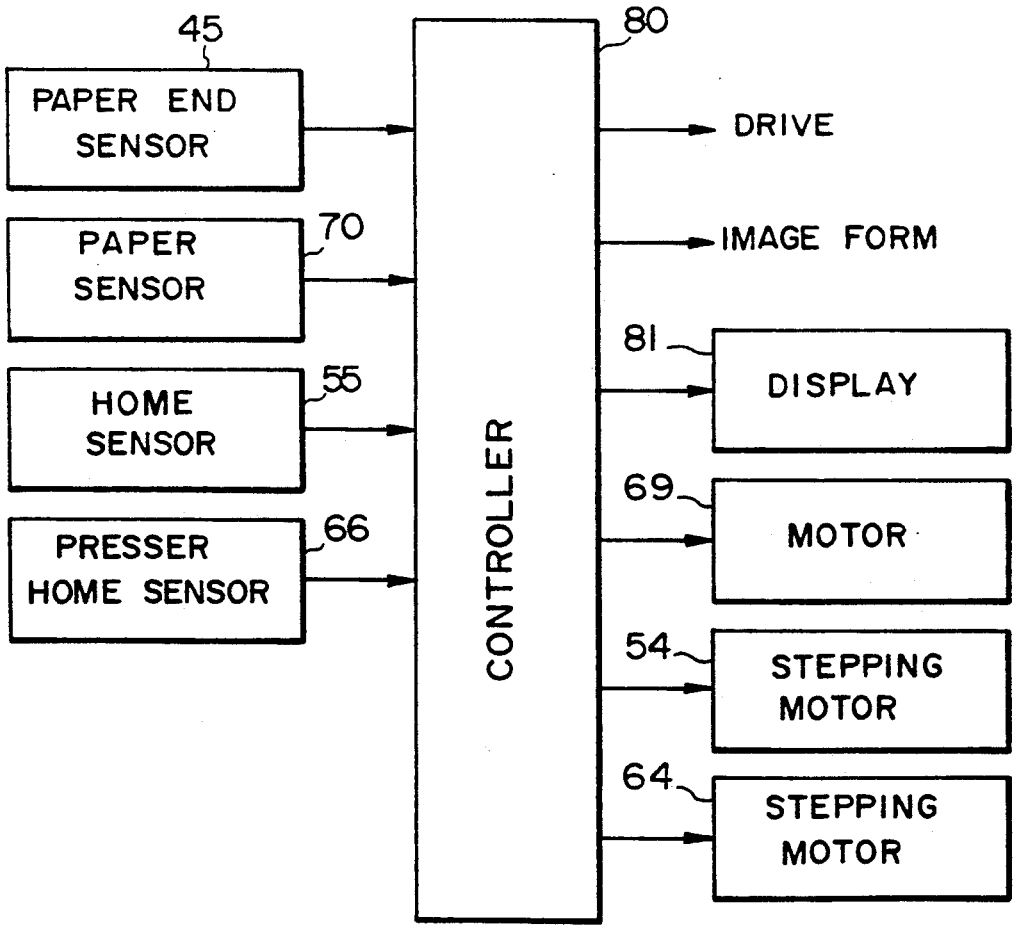
FIG. 4 is a block diagram schematically showing a controller associated with the embodiment.

Referring to FIG. 4, a controller 80 has a CPU for making various decisions and executing various kinds of processing, a program memory in the form of a ROM storing programs and fixed data necessary for the control over the side fences 22 and 23 and presser plate 65, a data memory in the form of a RAM storing processing data, and in I/O interface. The controller 80 is implemented with a microcomputer and has drivers for driving the steping motors 54 and 64 as well. The paper end sensor 45, paper sensor 70, home sensor 55, and presser plate home sensor 66 are connected to the controller 80. The controller 80 feeds drive signals to the pick-up roller 41 and other feed members included in the paper feeding arrangement 31, various signals to image forming units, end-of-paper signals to a display 81 provided on an operation board, a drive signal to the motor 69 associated with the bottom plate 24, and drive signals to the stepping motors 54 and 64.

Figure 5:
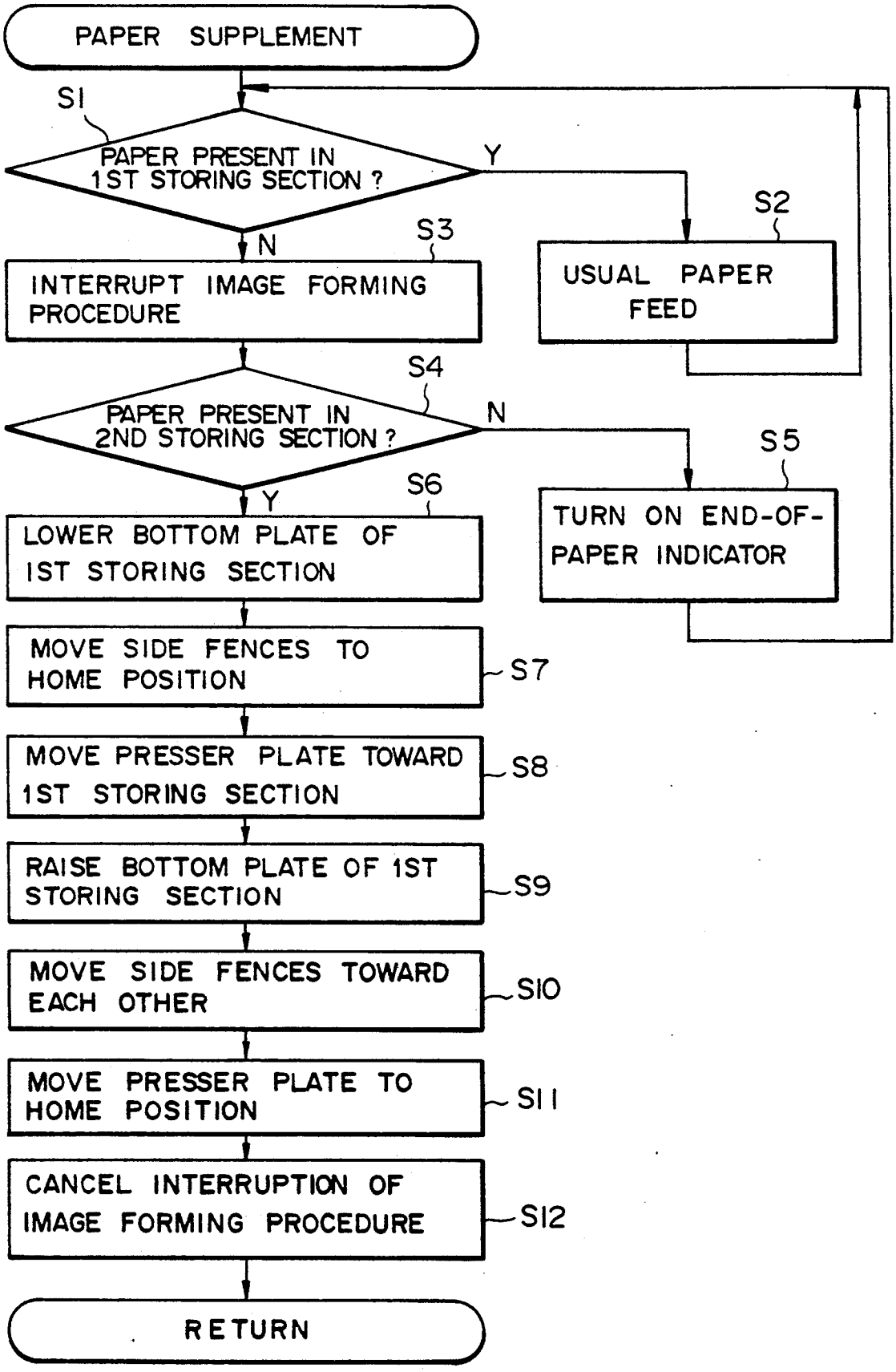
FIG. 5 is a flowchart demonstrating a specific subroutine which the controller executes.

FIG. 5 shows a specific subroutine which the controller 80 executes for handing over the paper stack from the full storing section 30 to the empty storing section 20. As shown, when the main switch of a copier or similar equipment with which the paper feeding device is associated is turned on, the controller 80 references the output of the paper end sensor 45 to see if the first paper storing section 20 is empty (sensor 44 ON) (step S1). If the answer of the stop S1 is negative, N, the controller 80 executes a usual paper feed procedure, i.e., operates the pick-up roller 41 and separation roller pair 42 to sequentially feed the paper sheets P stacked on the bottom plate 24 one by one, the uppermost one being first (S2). If the answer of the step S1 is positive, Y, the controller 80 stops driving the paper feeding system and interrupts the operations of the various image forming sections (S3). Subsequently, the controller 80 determines whether or not the second paper storing section 30 is full by referencing the output of the paper sensor 70 (S4) and, if the answer is N, feeds a signal to the display 81, FIG. 4, for turning on an end-of-paper indicator (S5). Then, the program returns to the step S1.

If the answer of the step S4 is Y, the controller 80 energizes the motor 69 to raise the arm 27 from the solid-line position to the phantom-line position as shown in FIG. 1 until the bottom plate 24 becomes substantially flush with the upper surface 11*b* or the tray 11 (S6). Thereafter, the controller 80 energizes the stepping motor 54 to move side fences 22 and 23 away from each other to their home position (S7). As soon as the home sensor 55 senses the lug 22*a* of the side fence 22, the side fences 22 and 23 are brought to a stop. The stepping motor 64 is driven to rotate the wire 63 in the direction E, FIG. 2. As a result, the supplementary paper stack P is shifted from the second storing section 30 to the bottom plate 24 of the first storing section 20 until the leading edge thereof abuts against the front fence 21 (right end as viewed in FIG. 2).

The motor 69 is reversed to raise the bottom plate 24 to the position shown in FIG. 1 (S9). Then, the stepping motor 54 is reversed to move the side fences 22 and 23 toward each other (S10), thereby positioning the side edges of the paper stack P. The stepping motor 64 is reversed to return the presser plate 65 to the left as viewed in FIG. 2. As soon as the home sensor 66 senses the tongue 65*a* of the presser plate 65 (S11), the controller 80 causes the image forming units to resume their operations (S12). Thereafter, the program returns to the main routine.

Figure 6:
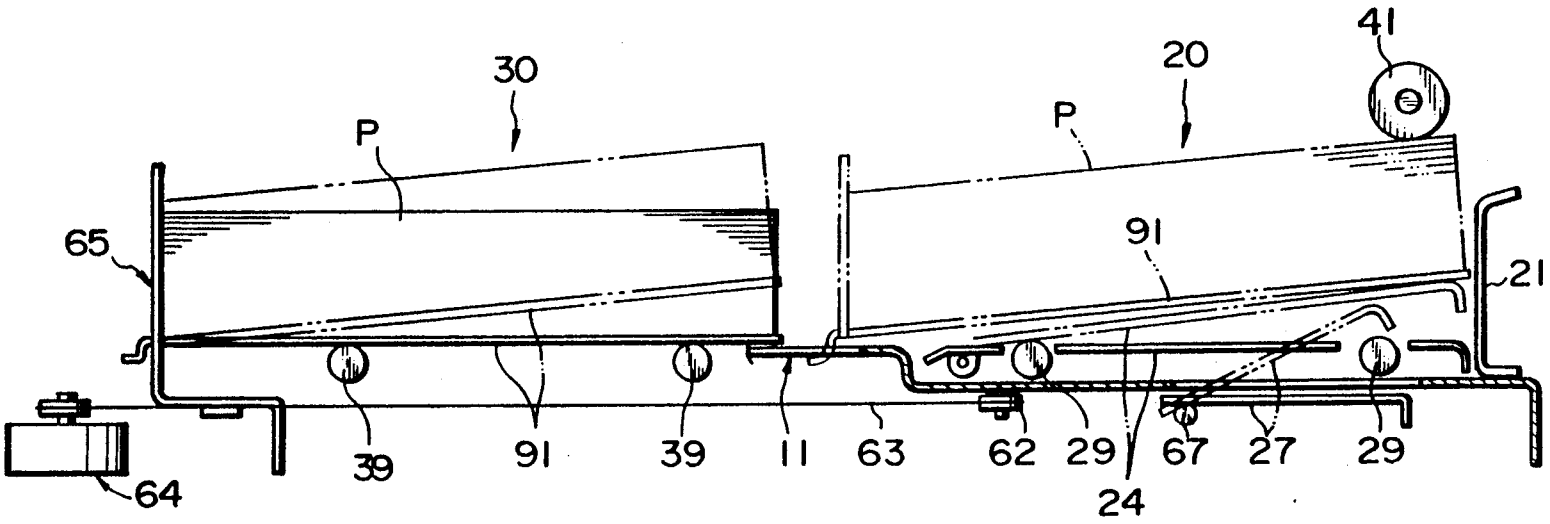
FIG. 6 is a view showing an alternative embodiment of the present invention.

Referring to FIG. 6, an alternative embodiment of the present invention is shown in which the second paper storing section 30 is also provided with a bottom plate. In the figures, the same or similar components and structural elements are degignated by like reference numerals, and redundant description will be avoided for simplicity. As shown, a bottom plate 91 is rotatably supported by a vertically extending portion of the presser plate 65 at one end thereof (left end in the figure). The bottom plate 91 rests on the rotatable member 39. When the first storing section 20 runs out of paper sheets P, the steping motor 64 is driven to rotate the wire 63, as in the previous embodiment. As a result, the presser plate 65 is moved toward the first storing section while entraining the bottom plate 91. Hence, the paper stack P of the second storing section 91 is moved by the bottom plate 91 which rolls on the rotatable members 29, until it abuts against the front fence 21. Thereafter, as the arm 27 is rotated counterclockwise in FIG. 6, the bottom plate 24 of the first storing section 20 and the bottom plate 91 of the second storing section 30 having been positioned above the bottom plate 24 are raised as indicated by phantom lines. This is followed by the same sequences of steps as in the first embodiment.

If desired, the second storing section 30 shown in FIG. 1 or 6 may be provided with a box-like configuration which is open at the top and the paper feed end and has the bottom thereof rotatably supported as the bottom plate 91.

Figure 7:
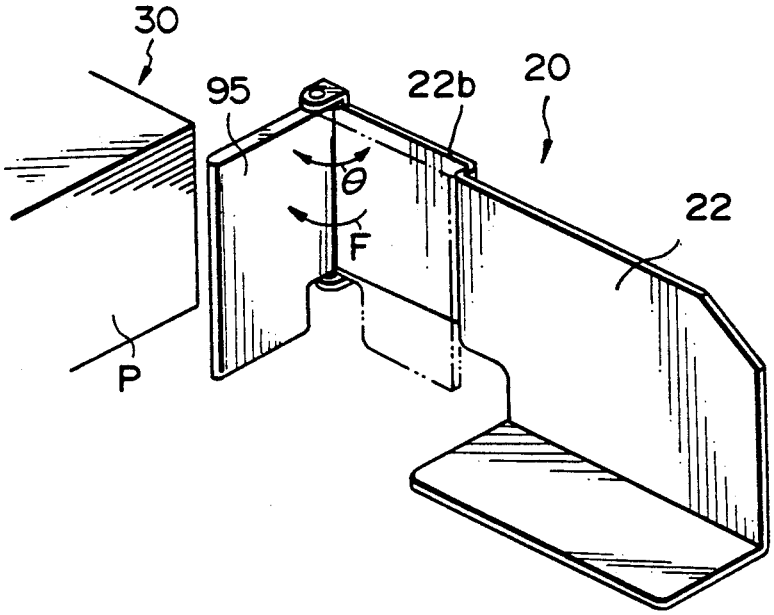
FIGS. 7 and 8 are views showing another alternative embodiment of the present invention.
Figure 8:
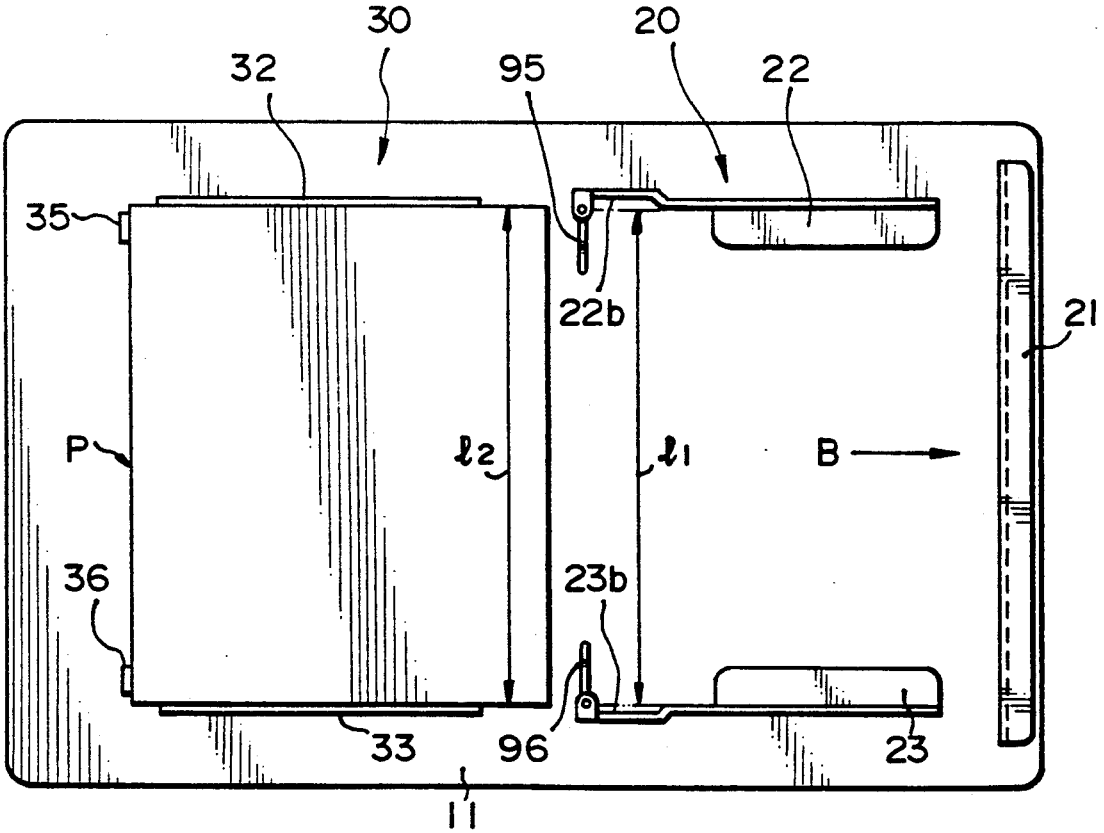

FIGS. 7 and 8 shows another alternative embodiment of the present invention in which the back fences of the first storing section each is rotatably mounted on associated one of the side fences. In the figures, the same or similar components as those shown in FIG. 2 are designated by like reference numerals, and redundant description will be avoided for simplicity. Specifically, the side fences 22 and 23 have respectively stepped portions **22*b* and 23*b* at the end of the second storing section 30. Back fences 95 and 96 are rotatably mounted on one end (left end in FIG. 8) of the stepped portions 22*b* and 23*b*, respectively. As shown in FIG. 7, the back fences 95 and 96 each is rotatable over an angle $\theta$ of substantially 90 degrees. The back fences 95 and 96 each has a thickness which is substantially equal to the depth of the associated stepped portions 22*b* and 22*b*. A coil spring, not shown, constantly urges each of the back fences 95 and 96 in a direction indicated by an arrow F in FIG. 7, while a stop, not shown, limits the angular movement of the associated back fence to 90 degrees. As shown in FIG. 8, when the back fences 95 and 96 are received in their associated stepped portions 22*b* and 23*b*, the distance $l_1$ between their facing surfaces is selected to be slightly greater than the width $l_2$ of the paper stack existing in the second storing section 30. In this condition, the supplementary paper stack P is handed over from the storing section 30 to the storing section 20. Hence, the leading edge (right edge in FIG. 8) of the paper stack P abuts against the back fences 95 and 96 and then advances into the storing section 20 while pushing down the back fences 95 and 96. If follows that even when the length of the paper stack P as measured in the paper feed direction B is greater than the distance between the front fence 21 and the fences 95 and 96, the paper stack P is fully accommodated in the storing sections 20 and 30. The back fences 95 and 96 may be magnetically retained on the stepped portions 22*b* and 23*b***, if desired.

Figure 9:
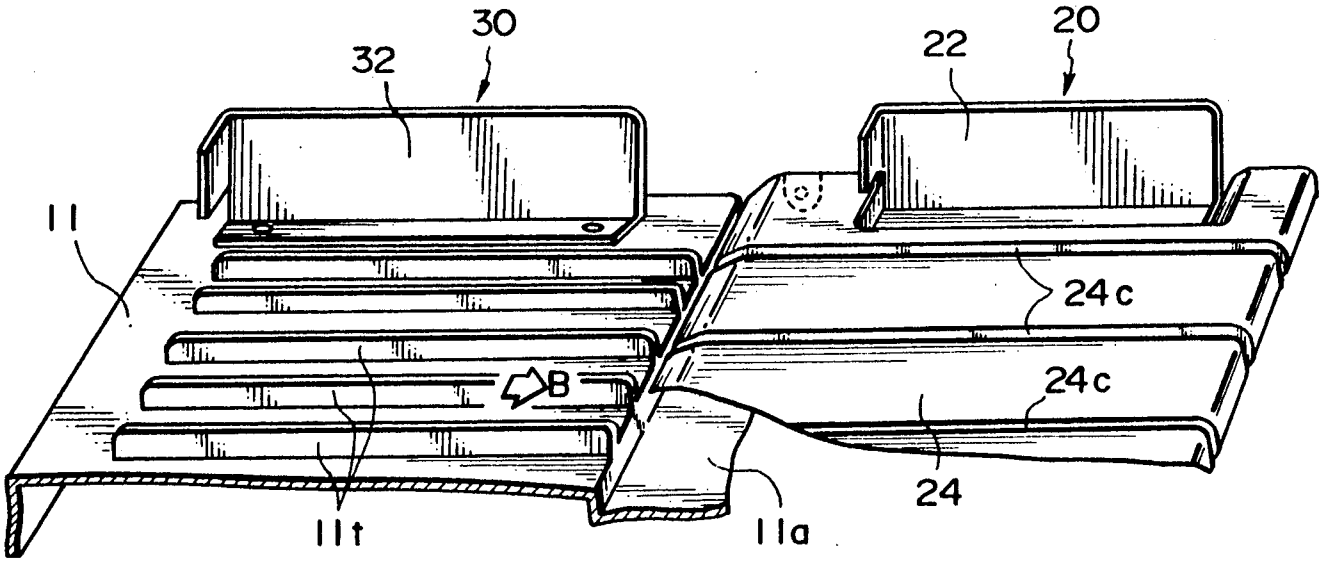
FIG. 9 is a perspective view showing still another embodiment of the present invention.

Referring to FIG. 9, another alternative embodiment of the present invention is shown in which the movable bottom plates are provided with ribs and beads. In FIG. 9, the same or similar components to those shown in FIG. 1 are designated by like reference numerals. As shown, the bottom plate 24 is provided with a plurality of (three in the embodiment) beads **24*c* on the upper surface thereof, while the tray 11 constituting the bottom of the second storing section 30 is provided with a plurality of (five in the embodiment) ribs 11*f* on the upper surface thereof. The beads 24*c* and ribs 11*f* extend in the paper feed direction B. The upper or guide surfaces of the beads 24*c* and ribs 11*b* which will contact the paper sheets are substantially flush with each other and smoothly finished to reduce the frictional resistance to the movement of the paper stack P. The beads 24*c* and ribs 11*b* which are the substitute for the rotatable members 29 and 39, FIG. 1, are also successful in shifting the paper sheets from the second storing section 30 to the first storing section 20** if the amount of the paper sheets is not great.

Figure 10:
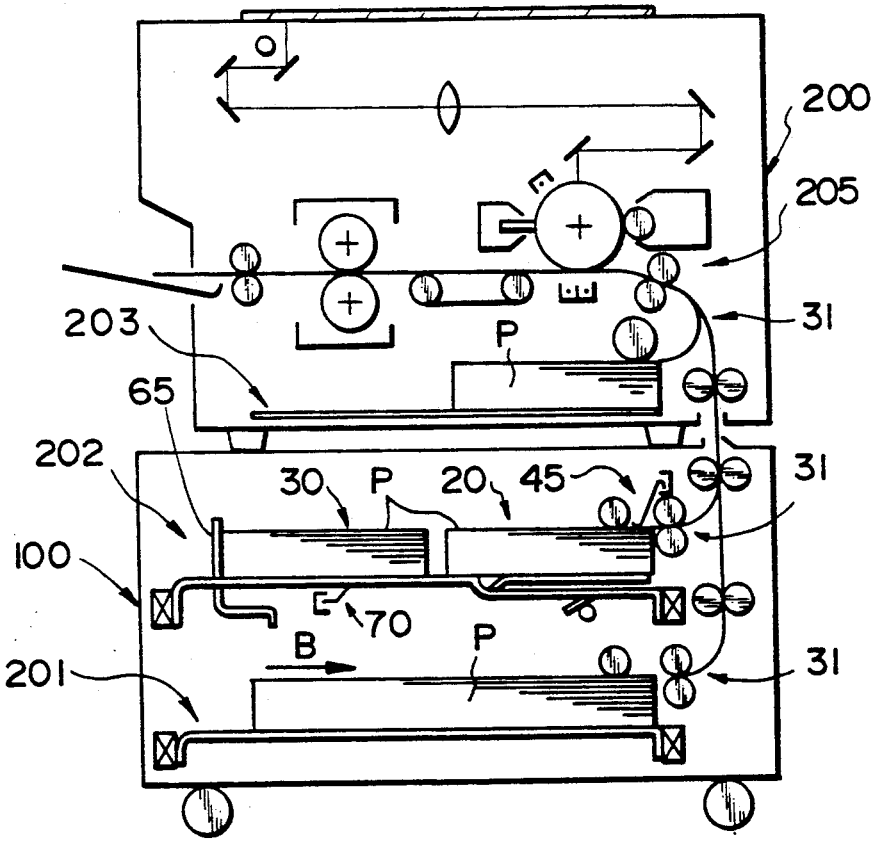
FIG. 10 is a view showing image forming equipment implemented with the present invention.

Referring to FIG. 10, a copier belonging to a family of image forming equipment to which the present invention is applicable will be described. As shown, the copier has a base 100 and a copier body 200 mounted on the base 100. The copier body 200 accommodates therein an image forming section 205 and various arrangements for forming an image. Incorporated in the base 100 and copier body 200 are paper storing sections 201, 202 and 203 (the number of which is open to choice) each being capable of accommodating a plurality of paper sheets P and equal in widthwise dimension to the others. The paper feed arrangement 31 is associated with each of the sections 201 to 203 for feeding paper sheets one by one therefrom. In this specific construction, the intermediate paper storing section 202 is made up of the first and second paper storing sections 20 and 30 each being half the length of the other paper storing sections 201 and 203 as measured in the paper feed direction. The paper end sensor 45 and the paper sensor 70 are associated with the first and second paper storing sections 20 and 30. The presser plate 65 shifts the paper stack collectively from the second storing section 30 to the first storing section 20, as stated earlier with reference to FIG. 1. When the paper end sensor 45 does not detect paper sheets and the paper sensor 70 detects paper sheets, the presser plate 65 is shifted to the right to transfer the paper sheets P from the storing section 30 to the storing section 20. The copier may be controlled by the control circuitry shown in FIG. 4.

The paper storing sections 201, 202 and 203 each can be pulled out in a direction perpendicular to a direction B shown in FIG. 1, i.e., toward the operator. This allows the operator to load the individual paper storing sections with paper sheets at the front of the copier, whereby not only easy operations are enhanced but also the spaces otherwise required at opposite sides of the copier are save. The storing section having the first and second paper storing sections may be disposed in the copier body 200 in place of the base 100 and may even be located above the image forming section 205.

In summary, it will be seen that the present invention achieves various unprecedented advances, as enumerated below.

(1) When a first paper storing section loaded with paper sheets of relatively small size runs out of the paper sheets, paper sheets of relatively small size are immediately supplemented from a second paper storing section to the first storing section. This allows a great number of paper sheets to be stored without resorting to an increase in the overall height of a paper feeding device. When the size of paper sheets is relatively large, the first and second storing sections are used at the same time to accommodate them.

(2) When the paper feeding device runs out of paper sheets, it prevents an image forming arrangement from performing wasteful operations.

(3) It is only when a first paper end sensor does not sense paper sheets and a second paper end sensor senses paper sheets that the paper stack is handed over from the second storing section to the first storing section. The device is therefore free from wasteful motions otherwise performed when the second storing section is empty.

4) When the first paper sensor determines that no paper sheets exist, the image forming procedure is interrupted. This is successful in eliminating wasteful operations of the image forming arrangement when paper sheets are absent.

(5) When the paper stack is transferred from the second storing section to the first storing section, a pair of side fences are moved away from each other to insure smooth transfer while preventing the stack from being disturbed.

(6) Usually, back fences position the trailing edge of the paper stack in the first storing section, i.e., in a predetermined paper feed position. In the event of transfer of the paper stack from the second section to the first storing section, the back fences are retracted to the outside of the paper moving area. The back fences, therefore, do not interfere with the transfer of the paper sheets and will also retract when paper sheets of relatively large size are used.

(7) The paper stack being shifted from the second storing second to the first storing section smoothly roll on rotatable members or slide on ribs and beads. The paper stack is therefore free from bends, folds, scratches or similar defects and can be driven by a minimum of force.

(8) In the second storing section, a bottom plate loaded with a paper stack rolls on rotatable members and, therefore, further promotes the smooth transport of the paper stack.

Various modifications will become possible for those skilled in the art after receiving the teachings of the present disclosure without departing from the scope thereof. For example, while the present invention has been shown and described as feeding paper sheets by using the widthwise center thereof as a reference, it is similarly practical with a side reference type system wherein paper sheets are fed along the edge of either one of a pair of side fences. Further, the present invention is applicable even to a paper feeding device of the type having a bottom plate which is elevatable which assuming a horizontal position.

What is claim is:

1. A device for feeding a plurality of paper sheets one by one to image forming equipment by paper feeding means, comprising:

a first paper storing section loaded with a stack of paper sheets in a position where said paper feeding means is capable of feeding said paper sheets;

means mounted in said first paper storing section for positioning a rear edge of the paper stack in said first paper storing section;

a second paper storing section adjoining said first paper storing section on a side opposite to a paper feed side of said first paper storing section;

a paper end sensor for sensing paper sheets stacked in said first paper storing section;

mechanical paper shifting means for positively and mechanically shifting paper sheets stacked in said second paper storing section collectively to said first paper storing section; and control means for controlling said paper shifting means and said rear edge positioning means such that when said paper end sensor determines that paper sheets are absent in said first paper storing section, said paper shifting means shifts paper sheets from said second paper storing section to said first paper storing section, and said rear edge positioning means moves to a position such as not to interfere with the shifting of the paper sheets to said first paper storing section.

2. A device as claimed in claim 1, wherein said control means further controls said image forming equipment such that when said paper end sensor determines that paper sheets are absent in said first paper storing section, said image forming equipment interrupts image forming processing and, when paper sheets are again accommodated in said first papers storing section, resumes said image forming processing.

3. A device as claimed in claim 1, further comprising:

a pair of side fences disposed in said first paper storing section and movable toward and away from each other to position opposite side edges of paper sheets;

said control means further controlling said pair of side fences such that when paper sheets are to be shifted from said second paper storing section to said first paper storing section, said side fences are moved away from each other by a predetermined distane.

4. The device as claimed in claim 1 wherein said means for positioning a rear edge of the paper stack comprises at least one back fence.

5. A device as claimed in claim 1, further comprising:

a first movable bottom plate disposed in said first paper storing section and loaded with paper sheets; and pressing means for pressing said paper sheets toward said paper feeding means via said first bottom plate;

said control means further controlling said pressing means such that said pressing means moves away from said paper feeding means when paper sheets are to be shifted from said second paper storing section to said first paper storing section.

6. A device as claimed in claim 5, further comprising:

a second bottom plate disposed in said second paper storing section and loaded with paper sheets;

a plurality of openings formed through each of said first and second bottom plates; and a plurality of rotatable members each being associated with respective one of said openings and rotatable in an intended direction of paper feed;

said control means further controlling said pressing means such that when said first bottom plate is lowered, said rotatable members protrude slightly an upper surface of said first bottom plate through said openings while said rotatable members associated with said second bottom plate constantly protrude slightly above an upper surface of said bottom plate through said openings.

7. A device as claimed in claim 6, wherein said control means further controlling said paper shifting means such that paper sheets are shifted from said second paper storing means to said first paper storing means by a displacement of said second bottom plate.

8. A device as claimed in claim 6, further comprising a plurality of beads and a plurality of ribs provided respectively on said first and second bottom plates to extend in the intended direction of paper feed, said beads and ribs protruding upward to a substantially same height.

9. A device for feeding a plurality of paper sheets one by one to image forming equipment by paper feeding means, comprising:

a plurality of paper storing means arranged in successive stages;

at least one of said plurality of paper storing means comprising:

a first paper storing section substantially one half the length of another paper storing means as measured in an intended direction of paper feed and located in a position where said paper feeding means is capable of feeding paper sheets; and a second storing section adjoining said first paper storing section on a side opposite to a paper feed side of said first paper storing section;

said device further comprising:

a first paper end sensor for sensing paper sheets in said first paper storing section;

a second paper end sensor for sensing paper sheets in said second paper storing section;

paper shifting means for shifting paper sheets collectively from said second paper storing section to said first paper storing section; and control means for controlling said paper shifting means such that said paper shifting means shifts paper sheets from second paper storing section to said first paper storing section when said first paper end sensor does not sense paper sheets and said second paper end sensor senses paper sheets.

10. A device as claimed in claim 9, wherein said control means further controlling said image forming equipment such that when said first paper end sensor does not detect paper end sensors, said image forming equipment interrupts image forming processing and, when said second paper end sensor detects paper sheets, resumes said image forming processing after said paper shifting means has shifted paper sheets from said second paper storing section to said first paper storing section.

11. A device as claimed in claim 9, further comprising:

a pair of side fences disposed in said first paper storing section and movable toward and away from each other to position opposite side edges of paper sheets;

said control means further controlling said pair of side fences such that when paper sheets are to be shifted from said second paper storing section to said first paper storing section, said side fences are moved away from each other by a predetermined distance.

12. A device as claimed in claim 9, further comprising:

at least one back fence for positioning a trailing edge of paper sheets in said first paper storing section;

said control means further controlling said back fence such that said back fence retracts, when paper sheets are to be shifted from said second paper storing section to said first paper storing section, from an area where said paper sheets move.

13. A device as claimed in claim 9, further comprising:

a first movable bottom plate disposed in said first paper storing section and loaded with paper sheets;

and pressing means for pressing said paper sheets toward said paper feeding means via said first bottom plate;

said control means further controlling said pressing means such that said pressing means moves away from said paper feeding means when paper sheets are to be shifted from said second paper storing section to said first paper storing section.

14. A device as claimed in claim 13, further comprising:

a second bottom plate disposed in said second paper storing section and loaded with paper sheets;

a plurality of openings formed through each of said first and second bottom plates; and a plurality of rotatable members each being associated with respective one of said openings and rotatable in an intended direction of paper feed;

said control further controlling said pressing means such that when said first bottom plate is lowered, said rotatable members protrude slightly above an upper surface of said first bottom plate through said openings while said rotatable members associated with said second bottom plate constantly protrude slightly above an upper surface of said second bottom plate through said openings.

15. A device as claimed in claim 14, wherein said control means further controlling said paper shifting means such that paper sheets are shifted from said second paper storing section to said first paper storing section by a displacement of said second bottom plate.

16. A device as claimed in claim 14, further comprising a plurality of beads and a plurality of ribs provided respectively on said first and second bottom plates to extend in the intended direction of paper feed, said beads and ribs protruding upward to a substantially same height.

* * * * *